US008598967B2

(12) United States Patent
Boffa et al.

(10) Patent No.: US 8,598,967 B2
(45) Date of Patent: Dec. 3, 2013

(54) TUNABLE WAVEGUIDE DELAY LINE HAVING A MOVABLE RIDGE FOR PROVIDING CONTINUOUS DELAY

(75) Inventors: Vincenzo Boffa, Milan (IT); Giuseppe Grassano, Milan (IT); Fabrizio Gatti, Milan (IT); Luciano Accatino, Turin (IT); Giorgio Bertin, Turin (IT); Alfredo Ruscitto, Turin (IT); Paolo Semenzato, Rome (IT)

(73) Assignee: Pirelli & C. S.p.A., Milan (IT)

( * ) Notice: Subject to any disclaimer, the term of this patent is extended or adjusted under 35 U.S.C. 154(b) by 414 days.

(21) Appl. No.: 12/745,202

(22) PCT Filed: Nov. 28, 2007

(86) PCT No.: PCT/EP2007/010318

§ 371 (c)(1),
(2), (4) Date: Sep. 3, 2010

(87) PCT Pub. No.: WO2009/068051

PCT Pub. Date: Jun. 4, 2009

(65) Prior Publication Data

US 2011/0001579 A1 Jan. 6, 2011

(51) Int. Cl.
*H01P 1/18* (2006.01)

(52) U.S. Cl.
USPC ..... 333/159; 333/33

(58) Field of Classification Search
USPC ..... 333/159, 157, 248, 33
See application file for complete search history.

(56) References Cited

U.S. PATENT DOCUMENTS

| | | | | | |
|---|---|---|---|---|---|
| 2,546,840 | A * | 3/1951 | Tyrrell | ..... | 333/159 |
| 2,591,329 | A * | 4/1952 | Zaleski | ..... | 324/644 |
| 2,930,040 | A * | 3/1960 | Weil | ..... | 343/756 |
| 3,783,221 | A * | 1/1974 | Soulier | ..... | 219/693 |
| 3,882,396 | A | 5/1975 | Schneider | | |
| 4,072,902 | A | 2/1978 | Knox et al. | | |
| 8,076,997 | B2 * | 12/2011 | Bertin et al. | ..... | 333/159 |
| 2003/0042997 | A1 | 3/2003 | Baik et al. | | |

FOREIGN PATENT DOCUMENTS

| | | |
|---|---|---|
| GB | 591369 | 8/1947 |
| GB | 608494 | 9/1948 |
| WO | WO-2006/037364 A1 | 4/2006 |
| WO | WO-2007-137610 A1 | 12/2007 |

OTHER PUBLICATIONS

International Search Report from the European Patent Office for International Application No. PCT/EP2007/010318 (Mail date Aug. 13, 2008).

Poplavko et al., "Dielectric Based Frequency Agile Microwave Devices," 15th International Conference on Microwave, Radar and Wireless Communications, MIKON-2004, pp. 828-831, (2004).

(Continued)

*Primary Examiner* — Benny Lee
(74) *Attorney, Agent, or Firm* — Finnegan, Henderson, Farabow, Garrett & Dunner, L.L.P.

(57) ABSTRACT

A tunable delay line for radiofrequency or microwave frequency applications consists of at least one ridge waveguide in which the ridge is movable in the waveguide body so as to vary the width of an air gap defined between the longitudinal end surface of the ridge and a confronting member of the waveguide. The ridge is moved by an actuator external to the waveguide body.

18 Claims, 8 Drawing Sheets

(56) References Cited

OTHER PUBLICATIONS

Chang, "Partially Dielectric-Slab-Filled Waveguide Phase Shifter," IEEE Transactions on Microwave Theory and Techniques, vol. MTT-22, No. 5, pp. 481-485, (1974).

Arnold et al., "An Approximate Analysis of Dielectric-Ridge Loaded Waveguide," IEEE Transactions on Microwave Theory and Techniques, pp. 699-701, (1972).

* cited by examiner

TUNABLE WAVEGUIDE DELAY LINE HAVING A MOVABLE RIDGE FOR PROVIDING CONTINUOUS DELAY

CROSS REFERENCE TO RELATED APPLICATION

This application is a national phase application based on PCT/EP2007/010318, filed Nov. 28, 2007, the content of which is incorporated herein by reference.

FIELD OF THE INVENTION

The present invention refers to delay lines, and more particularly it concerns a tunable ridge waveguide delay line in which delay tuning is obtained by varying the width of an air gap defined between the ridge and a confronting waveguide element.

Preferably, but not exclusively, the present invention has been developed in view of its use in telecommunications applications where it is required to change and control time delay and phase shift of high power electromagnetic signals in radiofrequency and microwave frequency ranges, while introducing limited power losses. Examples of such preferred applications are phased array antennas and transmitting apparatuses of wireless communication systems exploiting the so-called Dynamic Delay Diversity (DDD) technique.

BACKGROUND OF THE INVENTION

Phased array antennas are electronically controlled scanning beam antennas including phase shifters or delay lines, usually tunable by electronic or electromechanical means, that provide a differential phase shift or delay on the signals feeding adjacent antenna elements or groups of elements.

DDD technique is a currently used technique for improving performance of wireless communication systems, in particular in downlink direction, by adding a delay diversity to the space and/or polarization diversity provided by transmitting antenna arrays. In other words, different elements in the array transmit differently delayed replicas of the same signal. At a receiver, the differently delayed replicas give rise to alternate constructive and destructive combinations. In the DDD technique, the delays are time-varying and are obtained by tunable delay lines connected in the signal paths towards different antenna elements.

A wireless communication system exploiting the DDD technique is disclosed for instance in WO 2006/037364 A.

Assuming for sake of simplicity that the signals to be delayed can be considered single-frequency signals, so that applying a time delay is equivalent to applying a phase shift, a delay line with length L introduces a phase shift $\phi=-\beta\cdot L$, or a delay $\tau=L*d\beta/d\omega$, on the signal propagating through it, $\beta$ being the propagation constant of the line and $\omega$ being the signal angular frequency. Thus, in order to vary the phase shift (or the delay), either $\beta$ or L is to be varied. The most commonly used solutions rely on a variation of $\beta$.

Several tunable delay lines based on the variation of $\beta$ are known in the art and are commercially available. A class of such delay lines rely upon the variation of the position of a dielectric or metal member within the waveguide cavity.

The paper "Dielectric Based Frequency Agile Microwave Devices", by Y. Poplavko, V. Kazmirenko, Y. Prokopenko, M. Jeong, and S. Baik, presented at the 15th International Conference on Microwaves, Radar and Wireless Communications, 2004, MIKON-2004, pages 828-831, discloses a tunable phase-shifter consisting of a partially dielectrically filled waveguide, where two dielectric plates are placed inside the waveguide and the phase shifting tuning is obtained by changing the width of the air gap between said dielectric plates, thereby controlling the effective dielectric constant $\in_{eff}$ of the structure. This is obtained by moving at least one of the two dielectric plates up and down by means of a piezoelectric actuator. The waveguide structure has fixed impedance matching sections.

US 2003/0042997 A1 discloses a tunable phase-shifter consisting of a partially dielectric filled waveguide having an air-dielectric sandwich structure comprising either two dielectric members or a dielectric member and a metal plate separated by an air gap. The tuning of the phase shifting is obtained by changing the width of the air gap by moving either at least one or the dielectric members, or at least one out of the dielectric member and the metal plate, by means of a piezoelectric actuator.

The paper "Partially Dielectric-Slab-Filled Waveguide Phase Shifter", by C. T. M. Chang, IEEE Transactions on Microwave Theory and Techniques, Vol. MTT-22, No. 5, May 1974, pages 481-485, discloses a possible way to optimize matching between a dielectric slab-filled waveguide and an unloaded waveguide. An intermediate block is inserted between the dielectric slab-filled waveguide and the unloaded waveguide, which is a dielectric slab of an opportune width. Experimental results show that VSWR (Voltage Standing Wave Ratio) is kept to less than 1.15 ($|S11|>23$ dB).

The paper "An Approximate Analysis of Dielectric-Ridge Loaded Waveguide", R. M. Arnold and F. J. Rosenbaum, IEEE Transactions on Microwave Theory and Techniques, Oct. 1972, pages 699-701, analyzes the behavior of a waveguide partially filled with a dielectric slab. By varying the filling ratio it is possible to control the phase shift of an electromagnetic signal propagating inside the waveguide. The maximum phase shift obtained is about 100° between the case in which the dielectric slab is totally inserted into the waveguide and the case in which the dielectric slab is flush with the waveguide wall.

PCT patent application PCT/EP2006/005202, published as WO 2007137610, discloses a tunable delay line including a ridge waveguide with a dielectric perturbing member separated by a small air gap from a longitudinal end surface of the ridge and movable relative to the ridge for varying the width of the air gap and hence the propagation characteristics of the guide and the delay imparted by the line.

SUMMARY OF THE INVENTION

The Applicant has observed that the prior-art phase shifter of the paper by Y. Poplavko et al. and US 2003/0042997 A1, while exhibiting high tuning speed and short stroke moving parts, have a number of drawbacks:

- the width of the waveguide is a lower limit to the operation frequency (for instance, for applications around 2 GHz, which are the frequencies used in UMTS systems, the width of the proposed waveguide must be at least 7.5 cm, and the movable part must have the same width). Such considerable sizes make the device unsuitable for applications exploiting antenna diversity, where several delay lines might have to be installed in a same equipment. This size could be critical if the mechanical frequency of the movable plate is sufficiently high (tens of Hertz);
- the actuator is designed to be inside the waveguide and it cannot be completely shielded, even if matching section are presents; moreover, the air-gap discontinuity between matching steps and movable plate is located in the high density field region;

the width of the air-gap can be tuned in a range between 15 and 45 μm in order to have good efficiency in terms of phase-shifting per length. As a consequence, planarity of the moving part is absolutely critical and the structure must be built with precise and high-cost components.

fixed dielectric or metal steps are used for providing impedance matching. These steps must be realized and integrated with a resolution of tens of micron, in order to give designed results, and also this adds to the manufacture cost. Moreover said matching sections cannot be changed for different matching requirements.

The Applicant has further observed that the prior art described in the paper by C. T. M. Chang results in a fixed matching step, no tuning of which is possible once it has been designed and realized.

The Applicant has further observed that the prior art described in the paper by R. M. Arnold and F. J. Rosenbaum lacks efficiency in terms of phase shift per displacement (for given length, at given frequency): in fact the dielectric-ridge loaded waveguide analyzed in the paper can perform significantly only with a displacement of several millimeters, at microwave operating frequencies.

Finally, the Applicant has further observed that in the prior art described in PCT/EP2006/005202 the perturbing member moves in the region where the field is the strongest, and the performance is very sensitive to the geometrical accuracy of the waveguide components: the behavior of the delay line can therefore be difficult to reproduce.

Thus, the need exists of providing a tunable delay line which: is of reduced geometrical size, so that it can be employed also when several devices are to be formed or mounted in a same component and does not cause problems for high-frequency applications; exhibits good performance even with a relatively important displacement of the perturbing member, so that no complicate and expensive control is needed; is not particularly sensitive to the geometrical accuracy of the perturbing member, so that no difficult and expensive working is required for manufacture; and allows a tuning also of the impedance matching sections.

In a first aspect, there is provided a continuously tunable delay line comprising at least a first ridge waveguide with tunable propagation characteristics and including a waveguide body and a metal ridge, longitudinally extending within said waveguide body and having a longitudinal end surface separated by an air gap with variable width from a confronting waveguide element. The ridge is inserted into said waveguide body through an air slot provided in a wall of said waveguide body opposite to said waveguide element, and is connected to an actuator arranged to continuously move said ridge through said air slot so as to vary the width of said air gap and thereby to tune the delay.

The actuator is located externally of the waveguide body.

Advantageously, the ridge waveguide has characteristics such that the fundamental propagation mode is a hybrid mode including both transversal electric and transversal magnetic components, and such that the operating frequency falls in a frequency range where the propagation constant varies substantially linearly with frequency over a whole displacement range of the ridge.

The ridge is located in a central section of the waveguide, forming the actual delay element, and the delay line further comprises input and output sections at both sides of said central section for impedance matching between input and output ports and said central section, the input and output sections comprising respective movable members for the adjustment of the impedance of the input/output sections.

In an embodiment of the invention, the impedance matching is static, i.e. the movable members are arranged to be brought, during a calibration phase, to a position corresponding to an optimized overall impedance matching condition for an operating frequency range and are locked in use in that position.

In another embodiment of the invention, the impedance matching is dynamic, i.e. the movable members are displaceable synchronously with the ridge for tuning the impedance matching depending on the ridge position. In the embodiment with dynamic impedance matching, the movable ridge and the moving members in both the input and the output section can be driven by a common actuator, or by separate and independently operable actuators.

The delay line may also comprise two identical tunable ridge waveguides with movable ridge, where the output of a first waveguide is connected to the input of the other waveguide and the moving parts in both waveguides are driven by a common actuator.

Use of a ridge waveguide allows, as known, lowering the cut-off frequency of the fundamental mode of propagation, resulting in a reduction of the size of the devices. Also, a ridge guide exhibits a high mechanical strength and is compatible with the relative high signal powers encountered in the preferred applications and minimizes ohmic loss. Moreover, since the electromagnetic field in a ridge waveguide is mostly confined in the region of the air gap and is very weak in the region remote from the air gap, having a movable ridge through a slot formed in said region of weak electromagnetic field and driven by an actuator located externally of waveguide provides the advantage that propagation of the electromagnetic field inside the waveguide is not or is minimally affected. This also results in a behavior that is substantially insensitive to the geometrical accuracy of the various parts and thus is readily reproducible. The design of the delay line allows tuning the air gap width within a range that does not require use of sophisticated and expensive control equipments, and high efficiency is obtained with limited displacements. Finally, the provision of impedance matching sections with movable members allows an optimization of the matching for the specific application and even for the instant conditions of the delay element.

In a second aspect, the invention also provides an apparatus for transmitting a signal to a plurality of users of a wireless communication system via diversity antennas, said apparatus including, along a signal path towards said diversity antennas, at least one tunable delay line generating at least one variably-delayed replica of said signal and consisting of a tunable delay line according to the invention.

In another aspect, the invention also provides a phased-array antenna in which tunable ridge waveguide delay lines according to the invention provide a differential delay on signals feeding adjacent antenna elements or groups of elements.

In yet another aspect the invention also provides a wireless communication system including the above transmitting apparatus or the above phased array antenna.

BRIEF DESCRIPTION OF THE DRAWINGS

Further objects, characteristics and advantages of the invention will become apparent from the following description of preferred embodiments, given by way of non-limiting examples and illustrated in the accompanying drawings, in which.

DESCRIPTION OF THE PREFERRED EMBODIMENTS

Figure 1:
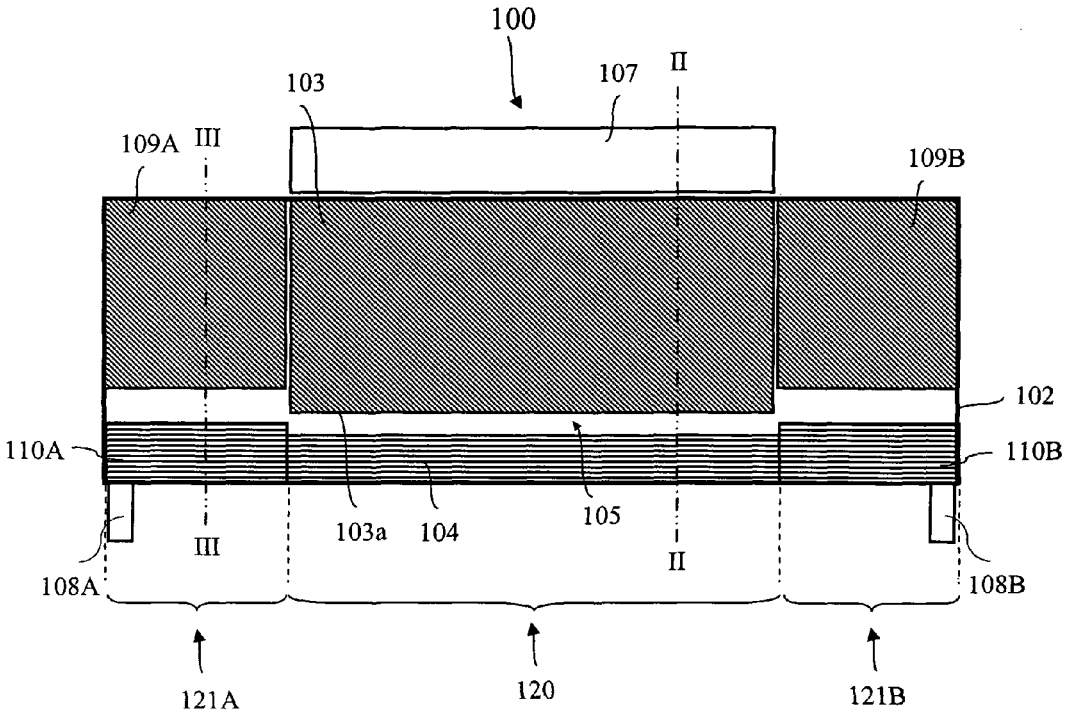
FIG. 1 is a schematic longitudinal cross-sectional view of a tunable delay line according to a first embodiment of the invention.
Figure 2:
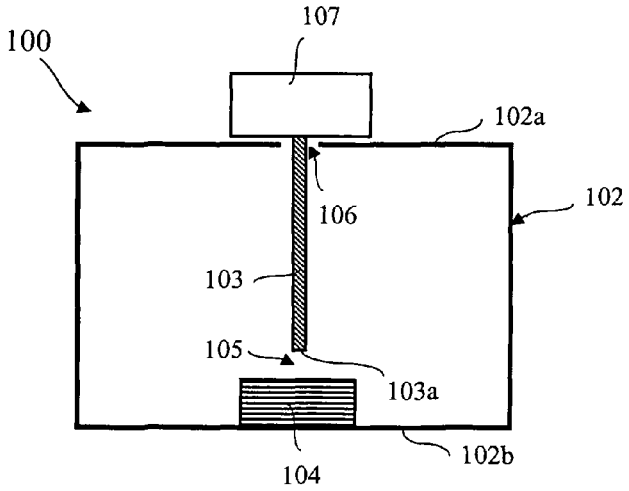
FIG. 2 is a schematic cross section taken along line II-II in FIG. 1.
Figure 3:
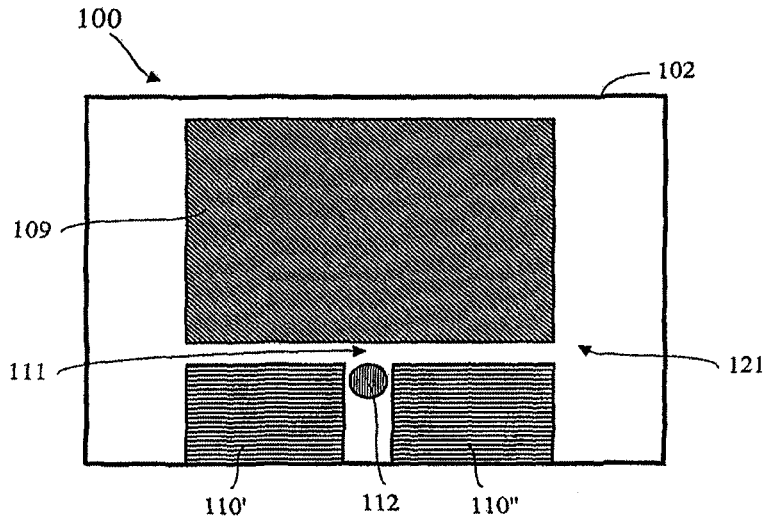
FIG. 3 is a schematic cross section taken along line III-III in FIG. 1.

Referring to FIGS. 1 to 3, there is schematically shown a first embodiment of a tunable ridge waveguide (TRW) delay line (or phase shifter) according to the invention, generally denoted by 100. Delay line 100 is preferably intended for telecommunication applications operating in radio frequency and microwave ranges and is to support high power signals (e.g. many tens of watts) introducing limited insertion losses (typically less than 1 dB).

The physical support for delay line 100 is a ridge waveguide, which consists of a metallic waveguide 102 with generally rectangular cross section having a longitudinal partition or ridge 103 (FIGS. 1 and 2). According to the invention, delay tuning in delay line 100 is obtained by moving ridge 103.

A ridge waveguide produces a significant lowering of the cut-off frequency of the fundamental mode of propagation. Lowering the cut-off frequency intrinsically implies a reduction of the size of the devices. Moreover, for a given cut-off frequency, a ridge waveguide has a greatly reduced cross sectional size with respect to a conventional rectangular waveguide.

Basically, delay line 100 consists of four main parts: a central section 120, forming the actual phase-shifting element; input and output sections 121A and 121B, providing RF signal impedance matching between the main central section 120 and two external ports 108A, 108B as shown in FIG. 1; and a linear actuator 107 for moving ridge 103 as shown in FIGS. 1 and 2.

Central section 120 corresponds to the waveguide region where ridge 103 extends. Ridge 103 is inserted into waveguide 102 through a longitudinal air slot 106 (FIG. 2) cut in a waveguide wall (e.g. assuming a horizontal arrangement of the waveguide, upper wall 102*a* (FIG. 2) remote from the free bottom end surface 103*a* (FIGS. 1 and 2) of the ridge) and is vertically displaceable through said slot 106.

Central section 120 further comprises a dielectric slab 104 (FIGS. 1 and 2), which is located on the waveguide wall opposite to the one provided with slot 106 (bottom wall 102*b* as shown in FIG. 2) and is separated from ridge 103 by a small air gap 105 (FIGS. 1 and 2). The dimensions of dielectric slab 104, as well as its dielectric constant, contribute to determine the effective dielectric constant $\beta_{eff}$ of the central block, and, consequently, the cut-off frequency of the propagation mode. In a practical example, operation in the range about 2 GHz, which is the range of interest for application of the device e.g. to UMTS systems, has been obtained by using a dielectric slab 104 of CaTiO3, with dielectric constant 165, a width of 7 mm and a height of 3 mm; waveguide 102 is 36 mm wide (i.e. substantially half the width of the prior art delay line disclosed in US 2003/0042997 A1) and 20 mm high, while metallic ridge 103 is 1 mm wide (assuming for simplicity a constant width) and 70 mm long.

However, dielectric slab 104 could even be dispensed with, in which case delay tuning can be obtained by varying the width of the air gap between the bottom end of ridge 103 and wall 102*b*.

Input and output sections 121A and 121B are each composed of a signal feeder 112 (shown only in FIG. 3), obtained e.g. by short-circuiting the inner conductor of the coaxial connector of the respective port 108 (A, B), and a number of metallic and dielectric elements 109 (A, B) and 110 (A, B), respectively (as shown in FIG. 1), the relative position of which is generally adjustable for the reasons that will be explained below. In particular, as shown in FIG. 3, each section 121 includes one movable metallic element 109 and a pair of fixed dielectric bricks 110', 110", located at both sides of feeder 112 and fastened to bottom wall 102*b* of the waveguide. These bricks are introduced in order to facilitate the coupling with central section 120.

Linear actuator 107 is placed externally of waveguide 102 and is connected to ridge 103 in order to move it up and down through slot 106 to vary the width of air gap 105. Actuator 107 can be a conventional electromechanical actuator, suitable for varying the ridge position at a frequency of several tens of Hertz, e.g. a voice coil.

The provision of a movable ridge 103 driven by an actuator 107 located externally of waveguide 102 and connected to ridge 103 through air slot 106 in upper waveguide wall 102 remote from air gap 105 is an important feature of the present invention. Indeed, as known, in a ridge waveguide like that discussed above, the electromagnetic field is mostly confined in the region between metallic ridge 103 and dielectric element 104. i.e. in the region of air gap 105, and is very weak in the region close to upper waveguide wall 102*a* (see also FIGS. 4*a*, 4*b* discussed further below): thus, the presence of air slot 106 does not affect or at most scarcely affects the propagation of the electromagnetic field inside the waveguide.

The operation of tunable delay line 100 is as follows.

The RF signal enters the TRW device from input port (e.g. port 108A), propagates through input matching section 121A and then goes to central phase-shifting section 120. There, the electromagnetic field is mostly confined in the region between metallic ridge 103 and dielectric element 104, so that propagation properties are strongly dependent on the width of air-gap 105. Finally the signal passes through output matching section 121B and exits from output port 108B with a delay or phase shift $\tau(t)$, the instant value of which depends on the instant width of air gap 105.

More particularly, $t_{AB}$ may represent the delay introduced by delay line 101 for a given value of air gap 105. When the air gap is changed due to a displacement of ridge 103, a new propagation condition causes a different delay $t'_{AB}$. In this way, a delay variation $\Delta t = t'_{AB} - t_{AB}$ is produced.

Propagation properties of electromagnetic signals can be expressed in terms of propagation constant β representing the phase-shift of the signal per section of length, at a given frequency. A diagram showing the propagation constant β as a function of frequency is known as "dispersion diagram".

Figure 5:
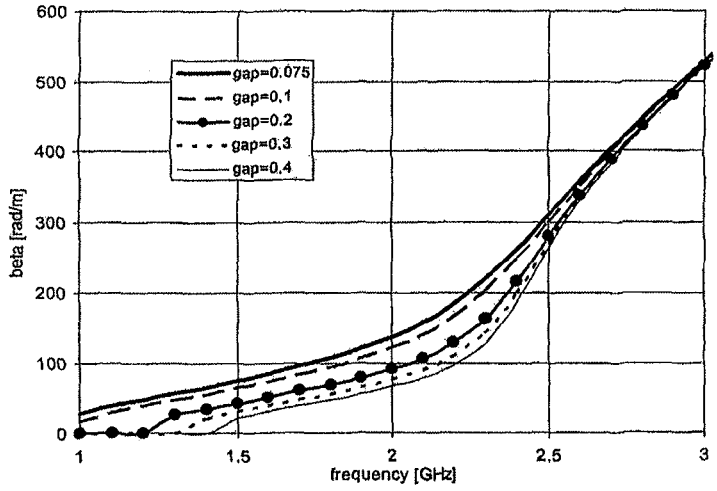
FIG. 5 is a dispersion diagram of a waveguide used in a delay line according to the invention.
Figure 4A:
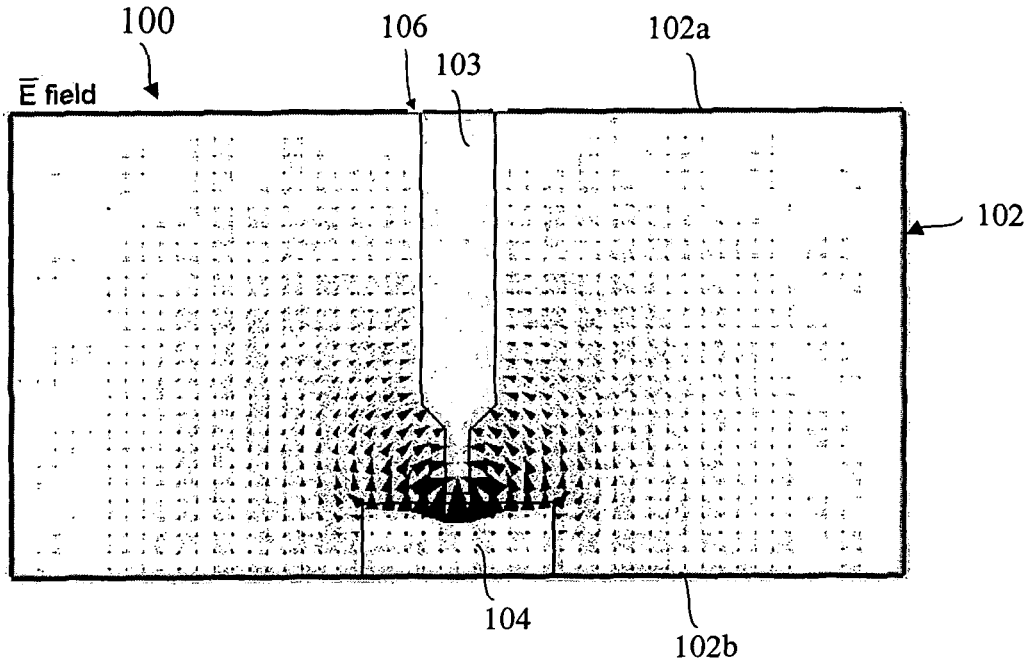
FIGS. 4*a* and 4*b* are enlarged views similar to FIG. 2, with the actuator removed, showing the E and H field distribution in a waveguide used in a delay line according to the invention.
Figure 4B:
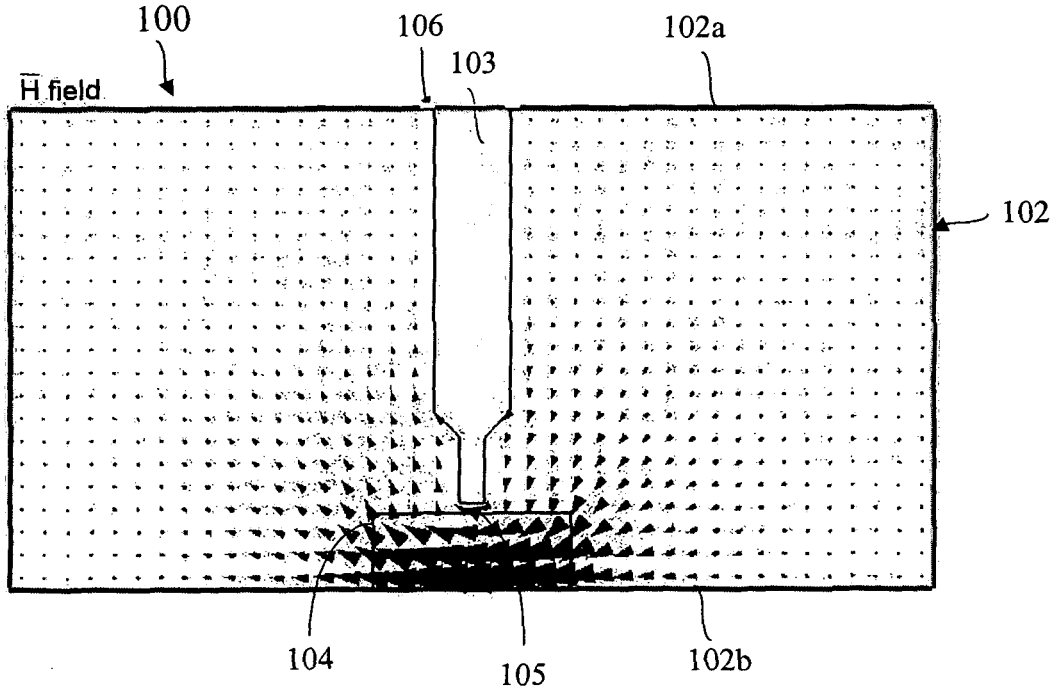
Figure 9:
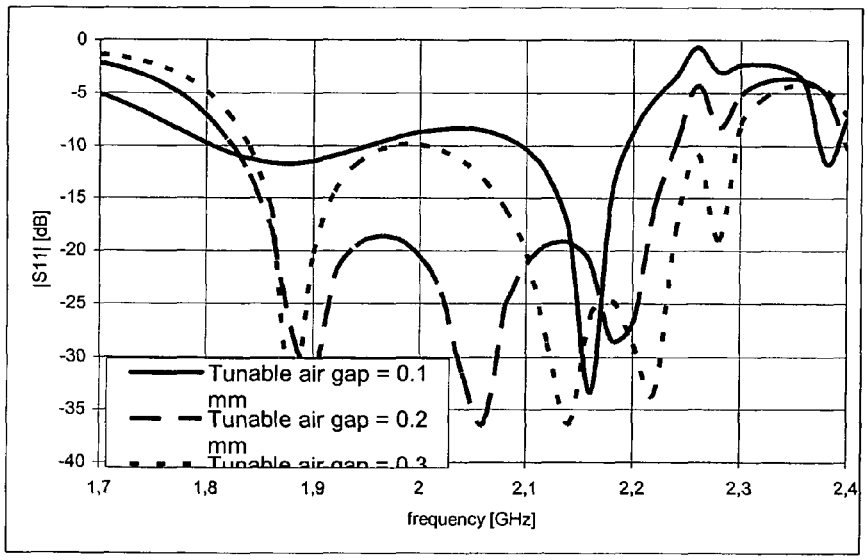
FIGS. 9 to 11 are graphs of the return loss versus frequency for different arrangements of the impedance matching sections.
Figure 10:
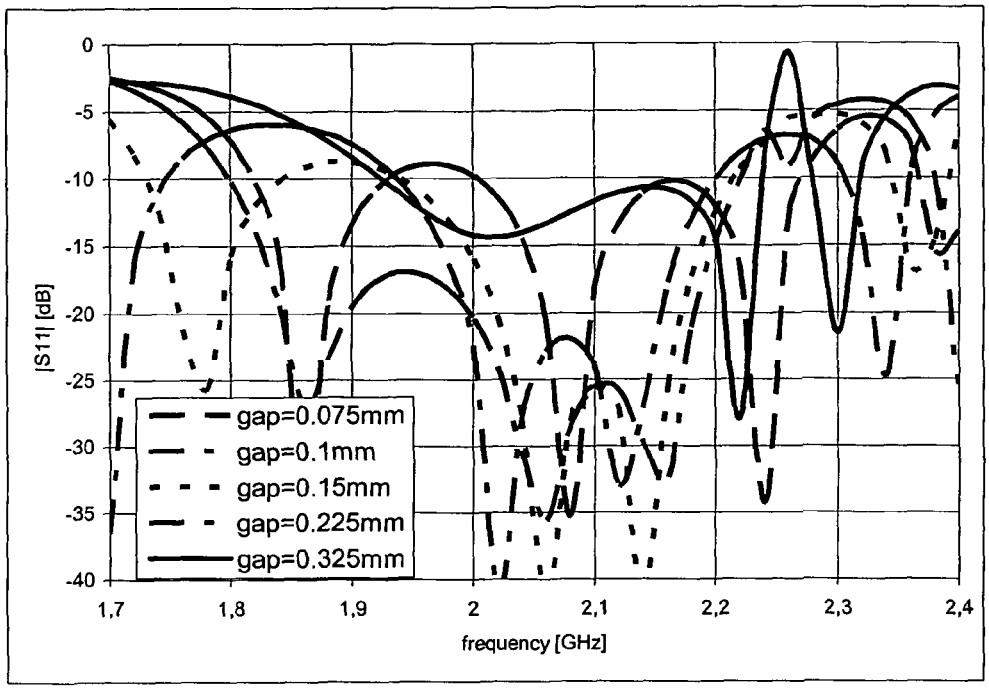
Figure 11:
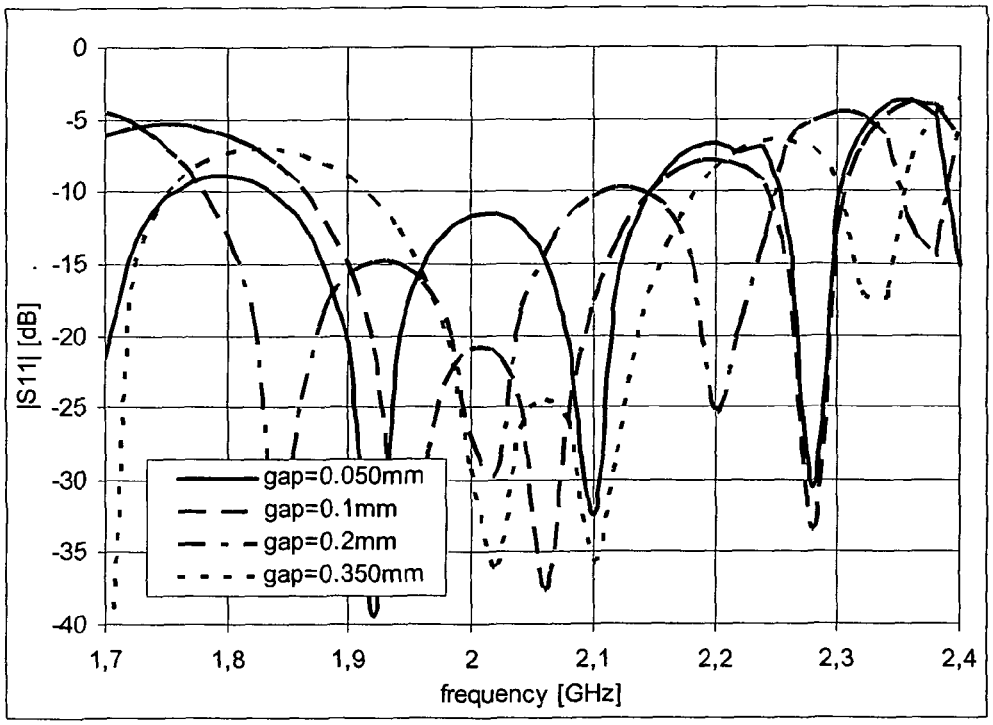

In order to explain in more details how the device works, let us refer to FIGS. 4A, 4B that show an enlarged cross-section of central section 120 in FIG. 1. Note that FIGS. 4A and 4B show a cross-sectional ridge shape more complex than the simplified rectangular shape of FIG. 3: in such embodiment, a limited portion close to the free end surface 103*a* has reduced thickness than a major portion connected to the actuator, the two portion being connected by inclined walls. FIGS. 4A and 4B are intended to show the electric (E) field distribution and the magnetic (H) field distribution, respectively, for the fundamental propagation mode. The reference labels used in FIGS. 4A and 4B are all described in reference to other figures in this application and retain the same meanings across different figures. The mode is of hybrid type because it includes both transversal electric (TE) and transversal magnetic (TM) components. Hybrid mode operation is obtained by a proper choice of the constructive parameters of the delay line. Dispersion diagram indicating β(f) in rad/m on the vertical axis vs. frequency in GHz on the horizontal axis in case of hybrid mode propagation is shown in FIG. 5, for a dielectric loaded ridge waveguide in the frequency range 1-3 GHz. for different values of the air gap width. The legend of FIG. 5 illustrates the particular line types used for different air gap widths, in mm. FIGS. 9-11 use similar legends.

For a given gap between metallic ridge 103 and dielectric slab 104, curve β(f) has a linear portion in a certain frequency range, where the TRW shows a non-dispersive behaviour. By changing the air gap width, the frequency range where β(f) has a linear behavior (referred to hereinafter as "linear frequency range") slightly changes, but it is possible to find a frequency range, independent of the air gap width, where the behavior is almost linear. It can be appreciated from FIG. 5 that the linear range includes the frequencies about 2 GHz, which are of interest for application e.g. to UMTS systems.

This means that the electromagnetic signal propagates from port A to port B without phase distortion.

Figure 6:
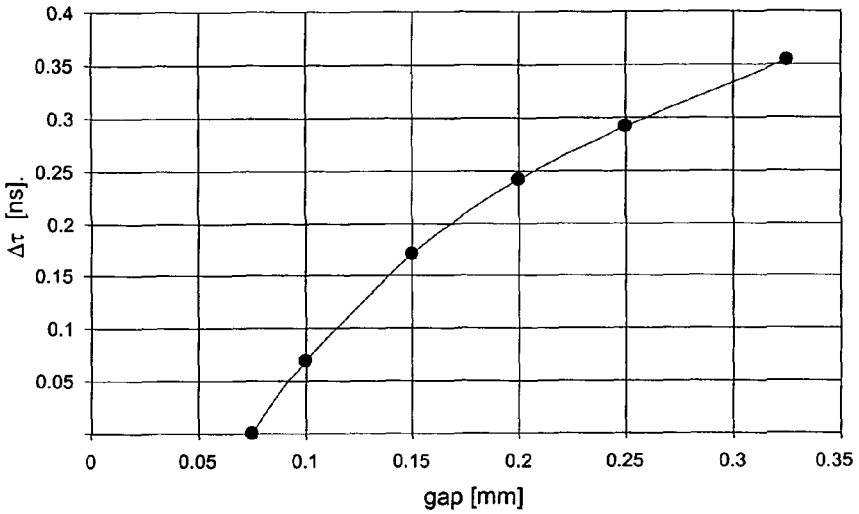
FIG. 6 is a graph of the delay versus the air gap width in a particular embodiment of delay line according to the invention.

FIG. 6 shows the behavior of delay variation of Δt in ns as a function of gap 105 in mm for a waveguide operating in the preferred 2 GHz range. The width of the air gap is tuned in the range between 0.075 mm, taken as a reference, and 0.325 mm. The graph shows that the maximum value of time delay difference in the air gap width range being considered is about 0.35 ns with respect to the reference. Thus, an efficient delay line is obtained without need of using micrometric variations of the air gap width, so that no sophisticated and expensive drive mechanism for ridge 103 is necessary. Rather, with a ridge of the size indicated above (70 mm long and 1 mm thick), a commercial low-cost electromechanical actuator can be used for varying the position of the movable ridge at a frequency of several tens of Hertz.

Another important aspect in the delay line design is the impedance matching between input-output coaxial connectors 108 (suffixes A, B characterizing the input and the output, respectively, are omitted hereinafter for simplicity) and phase-shifting central section 120.

As well known, in order to have impedance matching, the characteristic impedance $Z_{mb}$ of matching sections 121 must satisfy the relation $$Z_m = \sqrt{Z_c \cdot Z_p}$$

where $Z_c$ is the characteristic impedance of central section 120 and $Z_p$ is the characteristic impedance of port 108. $Z_p$ is typically fixed at 50Ω, while $Z_c$ presents a dependence on the width of air gap 105. According to the invention, the impedance of matching sections 121 can be externally tuned in order to optimize impedance matching of the whole device by acting on the relative position of metallic element 109 relative to feeder 112 (FIG. 3) and hence on the width of air gap 111 (FIG. 3) therebetween.

In the embodiment illustrated in FIGS. 1 to 3, impedance matching is "static", in the sense that, once the position corresponding to best overall matching condition at a given frequency range has been identified, the movable elements (e.g. metallic blocks 109) of matching sections 121 are locked in that position, for example by means of external screws (not shown).

Figure 7:
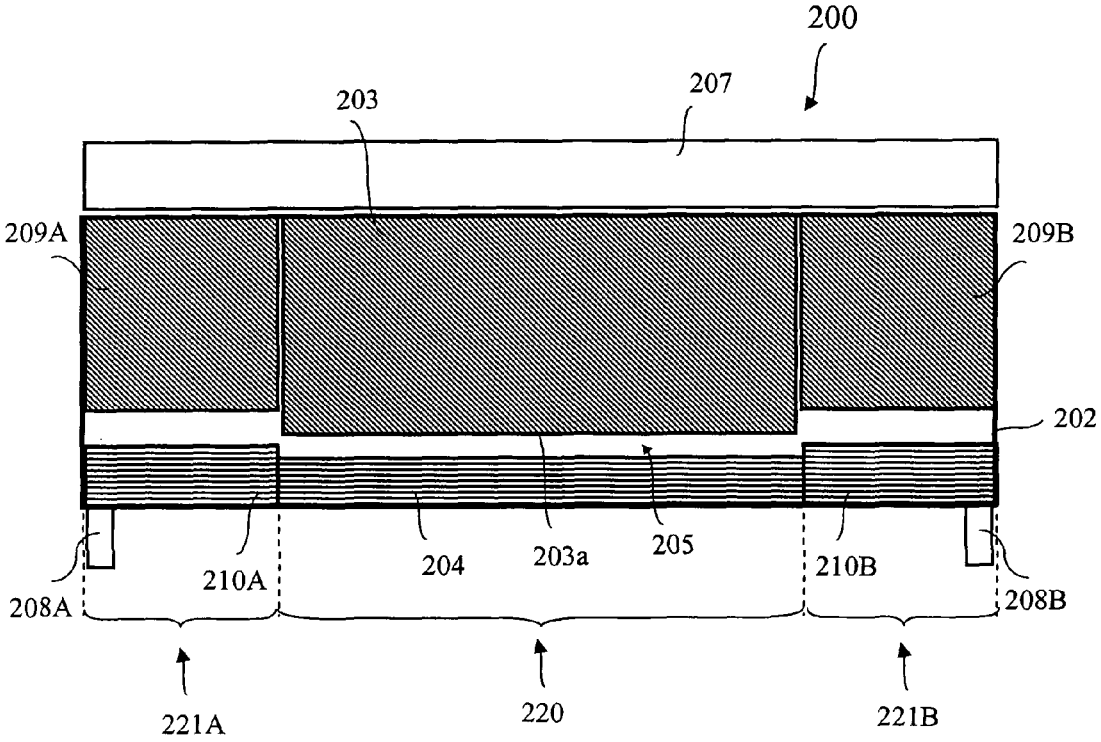
FIG. 7 is a schematic longitudinal cross-sectional view of a tunable delay line according to a first variant of the embodiment of FIG. 1.
Figure 8:
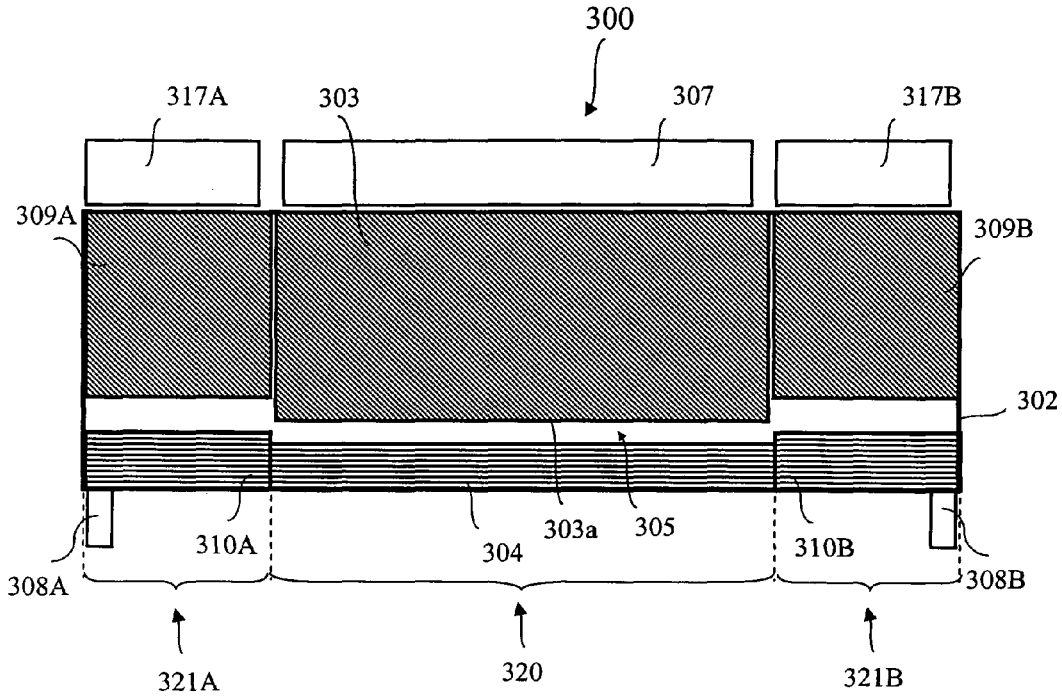
FIG. 8 is a schematic longitudinal cross-sectional view of a tunable delay line according to a second variant of the embodiment of FIG. 1.

In the variants shown in FIGS. 7 and 8, where elements corresponding to those shown in FIGS. 1 to 3 are denoted by like reference numerals, beginning with digit 2 or 3, respectively, impedance matching is dynamic, and metallic blocks 209A and 209B (FIG. 7), 309A and 309B (FIG. 8) of matching sections 221A, 221B (FIG. 7), 321A, 321B (FIG. 8) are externally moved synchronously with ridge 203 (FIG. 7), 303 (FIG. 8), in order to provide a tunable adaptive impedance matching.

In particular, in the arrangement shown in FIG. 7, the displacement of metallic ridge 203 matches the displacement of metallic blocks 209A, 209B and a unique linear actuator 207 is used for moving both metallic ridge 203 and metallic members 209A, 209B.

In the arrangement shown in FIG. 8, the displacement of metallic ridge 303 does not match the displacement of movable elements of matching sections 321A, 321B and different linear actuators 307, 317A, 317B are used, which are connected to moving ridge 303 and to metallic elements 309A, 309B of matching sections 321A, 321B, respectively, so that the widths of air gap 305 and of the air gaps between metallic elements 309A, 309B and the respective feeders can be individually and independently adjusted. Actuators 317A, 317B can be electromechanical linear actuators like actuator 307.

The graphs of FIGS. 9 to 11 allow evaluating the effect of the optimization and tuning of impedance matching on the behavior of the delay line. Such behavior is evaluated for each of FIGS. 9 to 11 in terms of return loss $|S_{11}|$ in dB at the input port of the delay line on the vertical axis versus frequency (in GHz) at different widths of the air gap between the moving ridge and the dielectric slab on the horizontal axis. For $|S_{11}|$ higher than 10 dB, matching condition is usually considered satisfying. Considering the application to a mobile system, the frequency range of interest for the evaluation is in the range around 2 GHz. The graphs have been plotted considering impedance matching sections including one movable metallic block and two fixed refractory bricks as shown in FIG. 3, the dimensions of the bricks being 4.5 mm×7.5 mm×10 mm and the dimensions of the metallic block being 16 mm×15 mm×12 mm. The sizes of the waveguide body, the ridge and the dielectric slab are the same as indicated above.

FIG. 9 shows $|\vec{S}_{11}|$ for three different conditions of a matching section, i.e. for different widths of the air gap between the metallic element and the feeder, for a given position of the ridge. The graph shows that a satisfying matching condition is obtained for each position of tunable matching section in the frequency range from 2.1 GHz to 2.2 GHz.

FIG. 10 is a graph of return loss $|S_{11}|$ in [dB] on the vertical axis vs. frequency [GHz] on the horizontal axis, showing $|S_{11}|$ in case of a delay line like delay 100 of FIGS. 1 to 3, for an optimized condition of a tunable matching section 121 and for different positions of ridge 103. In this case, matching optimization leads to a good matching condition over the operating frequency range from 2.0 GHz to approximately 2.15 GHz and over substantially the whole range 0.075 mm to 0.325 mm of air gap widths.

Finally, the graph of FIG. 11 is plotted for the case of a delay line with "dynamic" impedance matching like delay line 200 of FIG. 4. In this case, a better matching condition than that shown in FIG. 10 is obtained over the operation frequency range, even for greater and smaller displacements. This depends to the fact that the device has a higher degree of freedom.

This suggests that, by independently moving the ridge and the metallic member by means of different and independent linear actuators, as depicted in FIG. 8, a further increase in the matching range could be obtained, even though at the expenses of a greater complication of the moving system.

Figure 12:
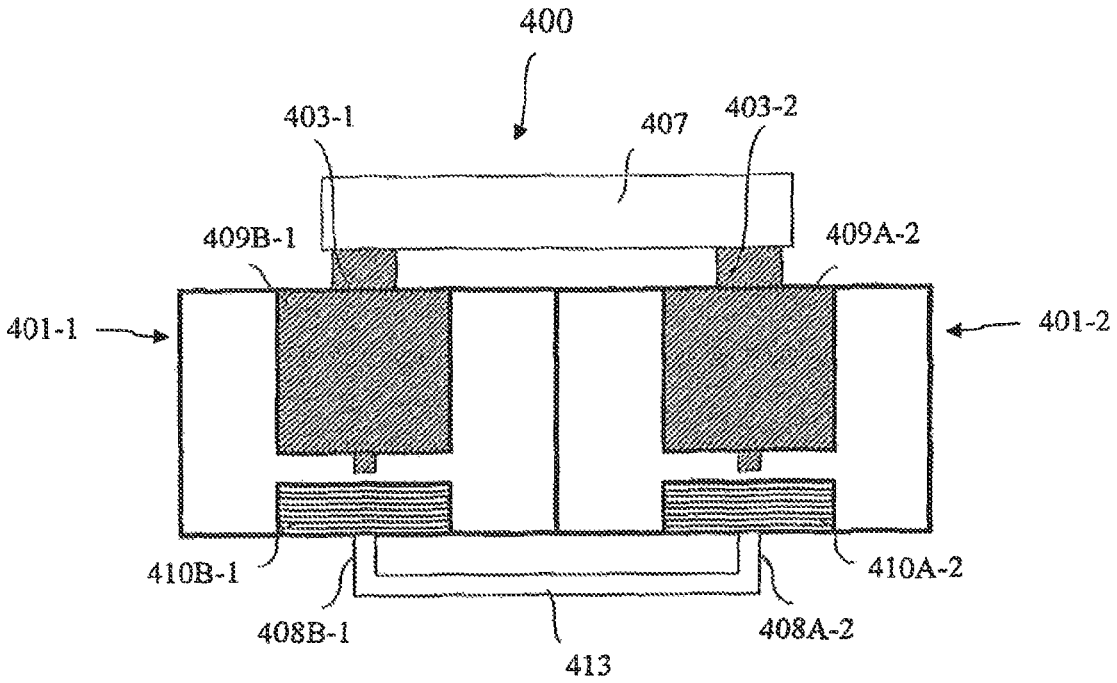
FIG. 12 is an end elevation view of a second embodiment of the invention.

FIG. 12 shows a further embodiment of the invention, in which delay line 400 consists of two tunable ridge waveguide delay lines 401-1, 401-2 (by way of non-limiting example, two delay lines like delay line 100 of FIGS. 1 to 3), which are placed parallel and adjacent to each other. In the drawing, corresponding elements in the two lines are identified by suffixes 1 and 2, respectively. The output port of one of the component lines, e.g. port 408B-1 of delay line 401-1, is connected to input port 408A-2 of delay line 401-2, e.g. by means of a coaxial line 413. The non-connected ports form the input and output ports of delay line 400. Ridges 403-1 and 403-2 are connected to a same actuator 407. FIG. 12 also shows metallic elements 409A-2 and 409B-1, as well as dielectric elements 410A-2 and 410B-1. By this embodiment, a given time delay tuning can be obtained by means of a longitudinally more compact device.

Figure 13:
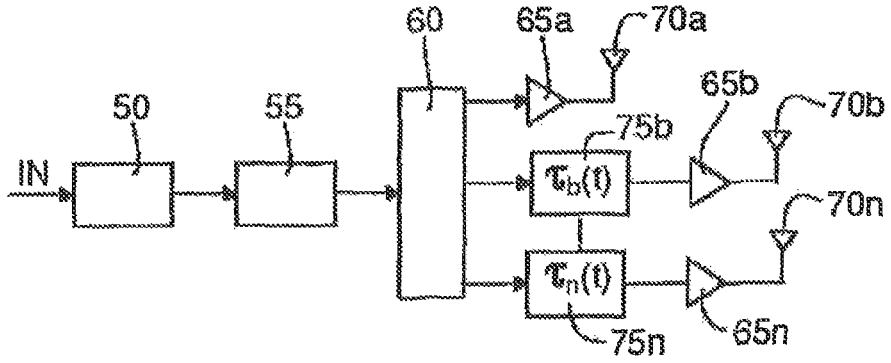
FIG. 13 is a schematic block diagram of a transmitting apparatus of a wireless communication system with dynamic delay diversity, using delay lines according to the invention.

FIG. 13 schematically shows a transmitter of a wireless communication system using dynamic delay diversity, like the system disclosed in the above mentioned WO 2006/037364 A. The transmitter can be employed in base stations, repeaters or even mobile stations of the system. Here, an input signal IN is fed to a base-band block 50 that outputs a base-band version of signal IN. The base-band signal is fed to an intermediate-frequency/radio-frequency block 55 connected to a signal splitter 60, which creates two or more signal replicas by sharing the power of the signal outgoing from block 55 among two or more paths leading, possibly through suitable amplifiers 65*a*, 65*b* . . . 65*n*, to respective antenna elements 70*a*, 70*b* . . . 70*n*. The first path is shown as an undelayed path, whereas respective tunable delay lines 75*b* . . . 75*n* according to the invention are arranged along the other paths, each line 75*b* . . . 75*n* delaying the respective signal replica by a time varying delay $\tau_b(t) \ldots \tau_n(t)$. The delay variation law may be different for each line. Of course, a delay line could be provided also along the first path.

Figure 14:
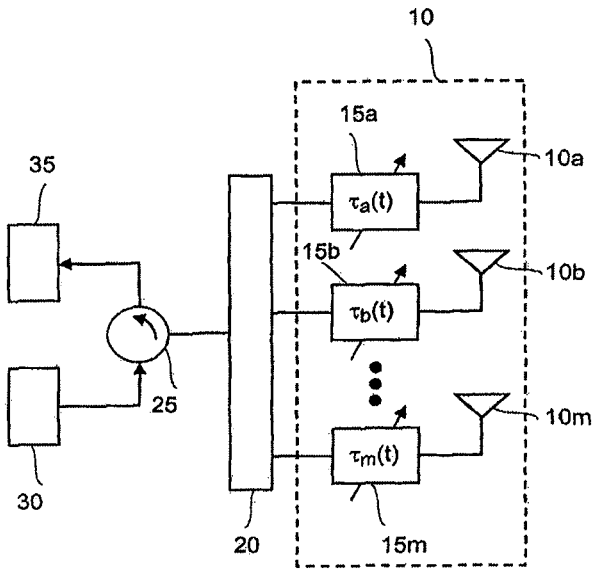
FIG. 14 is a schematic block diagram of a transmitting/receiving system using phased array antenna including delay lines according to the invention.

FIG. 14 schematically shows a possible block diagram of a signal transmitting-receiving system employing a phased array antenna. The antenna, generally denoted 10, includes a plurality of elements 10*a*, 10*b* . . . 10*m* associated with respective delay lines 15*a*, 15*b* . . . 15*m* made in accordance to the present invention arranged to introduce a respective tunable delay $t_a(t)$, $t_b(t) \ldots t_m(t)$ on the signal fed to each antenna element, so as to provide a differential delay on signals feeding adjacent antenna elements 10*a* . . . 10*n*. Of course, if the differential delay is to be provided on adjacent groups of antenna elements, all elements in a group would be connected to a same delay line. The antenna is connected to a feed network 20, in turn connected to means, schematized by circulator 25, separating the two propagation directions. Circulator 25 is in turn connected on the one side to transmitting-side equipment 30, and on the other side to receiving-side equipment 35.

It is clear that the above description has been given by way of non-limiting example and that the skilled in the art can make changes and modifications without departing from the scope of the invention as defined in the appended claims. In particular, even if a horizontal waveguide body resting on a major face has been shown, a different orientation can be envisaged, provided that the ridge moves through a slot in a region where the electromagnetic field is weak. The dielectric material of slab 104, 204, 304 can be different from CaTiO3, provided it has a high dielectric constant (e.g. >100) to confine the electromagnetic field. Piezoelectric actuators could be used in place of linear actuators. Also, even if a static impedance matching has been assumed for the double-line embodiment, a dynamic impedance matching, in particular of the kind shown in FIG. 7, could be provided for also in this embodiment.

The invention claimed is:

1. A continuously tunable delay line comprising at least a first ridge waveguide with tunable propagation characteristics comprising:

a waveguide body; and a metal ridge longitudinally extending within said waveguide body and having a longitudinal end surface separated by an air gap with variable width from a confronting waveguide element, wherein said ridge is inserted into said waveguide body through an air slot formed in a wall of said waveguide body opposite said waveguide element, and is connected to an actuator arranged to continuously move said ridge through said air slot so as to vary the width of said air gap and thereby tune the continuously tunable delay line, and wherein said ridge is arranged to operate according to a hybrid fundamental propagation mode comprising both transversal electric and transversal magnetic components, and at an operating frequency falling in a frequency range where the propagation constant varies substantially linearly with frequency over a whole displacement range of the ridge.

2. The delay line as claimed in claim 1, wherein said waveguide element confronting said longitudinal end surface of the ridge is a dielectric slab.

3. The delay line as claimed in claim 1, wherein said waveguide element confronting said longitudinal end surface of the ridge is a waveguide wall opposed to the wall in which said air slot is provided.

4. An apparatus for transmitting a signal to a plurality of users of a wireless communication system via diversity antennas, said apparatus comprising, along a signal path toward said diversity antennas, at least one tunable delay line for generating at least one replica of a signal delayed by a time varying delay, wherein said tunable delay line is a tunable delay line as claimed in claim 1.

5. A wireless communication system comprising the transmitting apparatus as claimed in claim 4.

6. A phased array antenna having a plurality of radiating elements and a plurality of tunable delay lines that provide a differential delay on signals feeding adjacent antenna elements or groups of elements, wherein each said tunable delay line is a tunable delay line as claimed in claim 1.

7. A wireless communication system comprising the phase array antenna as claimed in claim 6.

8. The delay line as claimed in claim 1, wherein said ridge is located in a central section of said ridge waveguide forming an actual delay element, and the tunable delay line further comprises input and output sections at opposite sides of said central section for impedance matching between input and output ports and said central section, wherein the input and output sections comprise movable members for the adjustment of impedance of the input/output sections.

9. The delay line as claimed in claim 1, wherein said actuator is located externally of said waveguide body.

10. The delay line as claimed in claim 9, wherein said actuator is a linear actuator.

11. The delay line as claimed in claim 1, further comprising a second ridge waveguide with tunable propagation characteristics, said second waveguide is identical to the first waveguide and is placed longitudinally parallel and adjacent thereto, wherein an output port of one of said first and second waveguides is connected to an input port of the other of said first and second waveguides.

12. The delay line as claimed in claim 11, wherein movable ridges of said first and second waveguides are connected to said actuator located externally of both of said first and second waveguides.

13. The delay line as claimed in claim 12, wherein said actuator is connected also to movable members in impedance matching sections provided in each of said first and second waveguides.

14. A continuously tunable delay line comprising at least a first ridge waveguide with tunable propagation characteristics comprising:

a waveguide body; and a metal ridge longitudinally extending within said waveguide body and having a longitudinal end surface separated by an air gap with variable width from a confronting waveguide element, wherein said ridge is inserted into said waveguide body through an air slot formed in a wall of said waveguide body opposite said waveguide element, and is connected to an actuator arranged to continuously move said ridge through said air slot so as to vary the width of said air gap and thereby tune the continuously tunable delay line, wherein said ridge is located in a central section of said ridge waveguide forming an actual delay element, and the tunable delay line further comprises input and output sections at opposite sides of said central section for impedance matching between input and output ports and said central section, wherein the input and output sections comprise movable members for the adjustment of impedance of the input/output sections, and wherein said movable members in the input section and the output section are connected to mutually independent actuators independent of the ridge actuator.

15. A continuously tunable delay line comprising at least a first ridge waveguide with tunable propagation characteristics comprising:

a waveguide body; and a metal ridge longitudinally extending within said waveguide body and having a longitudinal end surface separated by an air gap with variable width from a confronting waveguide element, wherein said ridge is inserted into said waveguide body through an air slot formed in a wall of said waveguide body opposite said waveguide element, and is connected to an actuator arranged to continuously move said ridge through said air slot so as to vary the width of said air gap and thereby tune the continuously tunable delay line, wherein said ridge is located in a central section of said ridge waveguide forming an actual delay element, and the tunable delay line further comprises input and output sections at opposite sides of said central section for impedance matching between input and output ports and said central section, wherein the input and output sections comprise movable members for the adjustment of impedance of the input/output sections, and wherein each of said input and output sections comprises a pair of dielectric bricks arranged at both sides of a feeder and fixed to the waveguide wall opposite to the wall in which said air slot is formed, and a movable metal member located on the side of the ridge and defining an adjustable or tunable air gap with said feeder.

16. A continuously tunable delay line comprising at least a first ridge waveguide with tunable propagation characteristics comprising:

a waveguide body; and a metal ridge longitudinally extending within said waveguide body and having a longitudinal end surface separated by an air gap with variable width from a confronting waveguide element, wherein said ridge is inserted into said waveguide body through an air slot formed in a wall of said waveguide body opposite said waveguide element, and is connected to an actuator arranged to continuously move said ridge through said air slot so as to vary the width of said air gap and thereby tune the continuously tunable delay line, wherein said ridge is located in a central section of said ridge waveguide forming an actual delay element, and the tunable delay line further comprises input and output sections at both sides of said central section for impedance matching between input and output ports and said central section, wherein the input and output sections comprise movable members for the adjustment of impedance of the input/output sections, and wherein said movable members are arranged to be moved, during a calibration phase, to a position corresponding to an optimized overall impedance matching condition for an operating frequency range and are locked in use in said position.

17. The delay line as claimed in claim 8, wherein said movable members are displaceable synchronously with the ridge for tuning the impedance matching depending on a ridge position.

18. The delay line as claimed in claim 17, wherein said movable members and said ridge are each connected to said actuator.

* * * * *